US010479589B2

(12) United States Patent
Holmes et al.

(10) Patent No.: US 10,479,589 B2
(45) Date of Patent: Nov. 19, 2019

(54) PHARMACEUTICAL CASSETTE

(71) Applicant: RXSAFE LLC, San Marcos, CA (US)

(72) Inventors: William K. Holmes, San Diego, CA (US); Aaron Arsenault, San Diego, CA (US)

(73) Assignee: RXSAFE LLC, Vista, CA (US)

( * ) Notice: Subject to any disclaimer, the term of this patent is extended or adjusted under 35 U.S.C. 154(b) by 0 days.

(21) Appl. No.: 14/611,715

(22) Filed: Feb. 2, 2015

(65) Prior Publication Data

US 2015/0217930 A1 Aug. 6, 2015

Related U.S. Application Data

(60) Provisional application No. 61/935,413, filed on Feb. 4, 2014.

(51) Int. Cl.
*B65D 83/04* (2006.01)

(52) U.S. Cl.
CPC ..... *B65D 83/0454* (2013.01)

(58) Field of Classification Search
CPC .. A61J 1/03; B65B 2009/047; B65D 83/0454; B65D 2583/0459; G07F 11/005
See application file for complete search history.

(56) References Cited

U.S. PATENT DOCUMENTS 3,712,507 A * 1/1973 Holt ..... G07F 11/54 221/150 R
3,876,269 A * 4/1975 Fisher ..... A47F 5/0037 206/534
3,998,356 A * 12/1976 Christensen ..... A61J 7/0481 221/2
4,747,514 A * 5/1988 Stone ..... A61J 7/0481 221/15
4,809,877 A * 3/1989 Albright ..... A61J 7/0481 221/121
4,811,764 A * 3/1989 McLaughlin ..... A61J 7/0084 141/104
4,911,327 A * 3/1990 Shepherd ..... A61J 7/0481 221/15

(Continued)

FOREIGN PATENT DOCUMENTS

WO 02/17850 3/2002

OTHER PUBLICATIONS

Extended European Search Report for Application No. 15153700.8 dated Jun. 16, 2015 (6 pages).

(Continued)

*Primary Examiner* — Gene O Crawford
*Assistant Examiner* — Kelvin L Randall, Jr.
(74) *Attorney, Agent, or Firm* — Michael Best & Friedrich LLP

(57) ABSTRACT

A cassette for dispensing pharmaceuticals includes a base defining an outlet and having a drive member. The drive member is configured to be rotated. The cassette also includes a plurality of plate assemblies supported by the base in a stacked configuration. Each plate assembly includes a plate body defining an opening aligned with the outlet, and a disk coupled to the drive member and defining a plurality of cubbies. Each disk is rotatable relative to the corresponding plate body by rotating the drive member of the base to selectively align each cubby with the opening in the plate body.

19 Claims, 6 Drawing Sheets

(56) References Cited

U.S. PATENT DOCUMENTS 5,522,525 A * 6/1996 McLaughlin ..... A61J 7/0481 221/15
5,549,217 A * 8/1996 Benarrouch ..... B65D 83/0409 221/155
5,564,593 A * 10/1996 East, Sr. ..... A61J 7/0481 221/121
7,293,673 B2 * 11/2007 Savage ..... A47B 88/00 221/119
2007/0029213 A1 * 2/2007 Hall ..... A61J 7/0084 206/217
2010/0030374 A1 * 2/2010 Saltsov ..... A61J 7/0084 700/225
2011/0049178 A1 * 3/2011 Chia ..... B65D 83/0454 221/76
2013/0073078 A1 * 3/2013 Handfield ..... A61J 7/0084 700/241
2013/0110283 A1 * 5/2013 Baarman ..... A61J 7/0084 700/236
2013/0318931 A1 12/2013 Holmes

OTHER PUBLICATIONS

Examination Report from the European Patent Office for Application No. 15 153 700.8 dated May 30, 2016 (6 pages).
First Office Action from the Mexican Industrial Property Law Office for Application No. MX/a/2015/001619 dated Jul. 19, 2017 (8 pages).
Mexican Institute of Industrial Property Office Action for Application No. MX/a/2015/001619 dated Nov. 22, 2017 (6 pages, English translation included).
Extended European Search Report for Application No. 15153700.8 dated Jan. 17, 2018 (7 pages).

* cited by examiner

PHARMACEUTICAL CASSETTE

CROSS-REFERENCE TO RELATED APPLICATIONS

This application claims priority to U.S. Provisional Application No. 61/935,413, filed on Feb. 4, 2014, which is hereby incorporated by reference in its entirety for all purposes.

BACKGROUND

The present invention relates to cassettes or containers for dispensing pharmaceuticals.

Systems and machines for storing, dispensing, and/or packaging pharmaceuticals (e.g., pills) in an automated fashion are becoming more common. These systems typically include containers filled with different types of pharmaceuticals. The containers are generally open bodies with fingers, brushes, or combs located within the bodies to help properly meter the pharmaceuticals out of the containers. Because different pharmaceuticals have different shapes and sizes, the containers need to be tuned differently to dispense the correct number of pharmaceuticals (e.g., one at a time). As such, a specific container is generally only usable to dispense one type (e.g., composition, brand, dosage, shape, etc.) of pharmaceutical. If a different type of pharmaceutical is stored in the container, the container typically needs to be retuned for the shape and size of the new pharmaceutical.

In order to accommodate new or uncommon types of pharmaceuticals, some pharmaceutical systems include separate tray assemblies. The tray assemblies are manually filled with, for example, 30-50 unique pharmaceuticals that may be manually placed in a prescription order. This process, however, can be labor-intensive and time-consuming. In addition, pharmaceuticals stored within tray assemblies are susceptible to theft, contamination, and error.

SUMMARY

In one embodiment, the invention provides a cassette for dispensing pharmaceuticals. The cassette includes a base defining an outlet and having a drive member. The drive member is configured to be rotated. The cassette also includes a plurality of plate assemblies supported by the base in a stacked configuration. Each plate assembly includes a plate body defining an opening aligned with the outlet, and a disk coupled to the drive member and defining a plurality of cubbies. Each disk is rotatable relative to the corresponding plate body by rotating the drive member of the base to selectively align each cubby with the opening in the plate body.

In another embodiment, the invention provides a method of dispensing pharmaceuticals from a cassette. The cassette includes a base and a plurality of plate assemblies supported by the base in a stacked configuration. The base defines an outlet and including a drive member. Each plate assembly includes a plate body defining an opening aligned with the outlet and a disk coupled to the drive member and defining a plurality of cubbies. The method includes coupling the drive member to a motor, rotating the disk of a first plate assembly relative to the corresponding plate body with the motor to selectively align each cubby of the disk of the first plate assembly with the opening in the corresponding plate body, and rotating the disk of a second plate assembly relative to the corresponding plate body with the motor to selectively align each cubby of the disk of the second plate assembly with the opening in the corresponding plate body.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
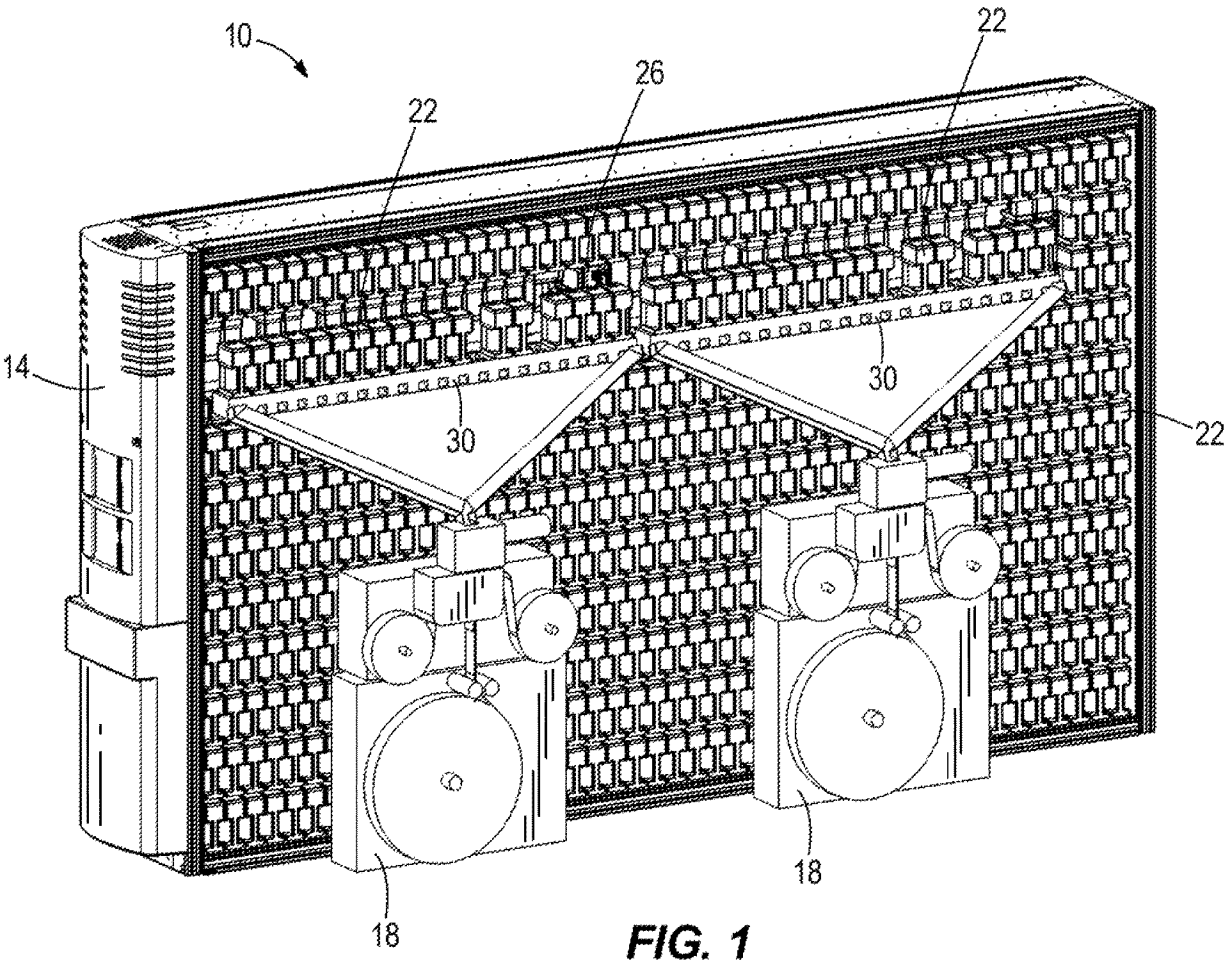
FIG. 1 is a perspective view of a pharmacy packaging system.

FIG. 1 illustrates a pharmacy packaging system 10. The system 10 is a self-contained system that stores, retrieves, and packages pharmaceuticals (e.g., pills, drugs, narcotics, or other medications), as disclosed in U.S. Patent Application Publication No. 2013/0318931, filed Mar. 15, 2013, the entire contents of which are incorporated by reference herein.

The illustrated system 10 includes a storage unit 14 and two automatic packaging units 18. The storage unit 14 stores a plurality of cassettes 22, or containers or canisters, containing a variety of pharmaceuticals. The packaging units 18 package the pharmaceuticals from the cassettes 22 into, for example, pouches for distribution to patients. The system 10 also includes a gantry assembly 26, or container-moving assembly, for moving the containers 22 between the storage unit 14 and the packaging units 18. The gantry assembly 26 is operable to position the cassettes 22 on motor bases 30 of the packaging units 18. When positioned on one of the motor bases 30, the motor base 30 selectively opens a port or outlet on a bottom of each cassette 22 to dispense pharmaceuticals from the cassette 22 into the corresponding packaging unit 18.

Figure 3:
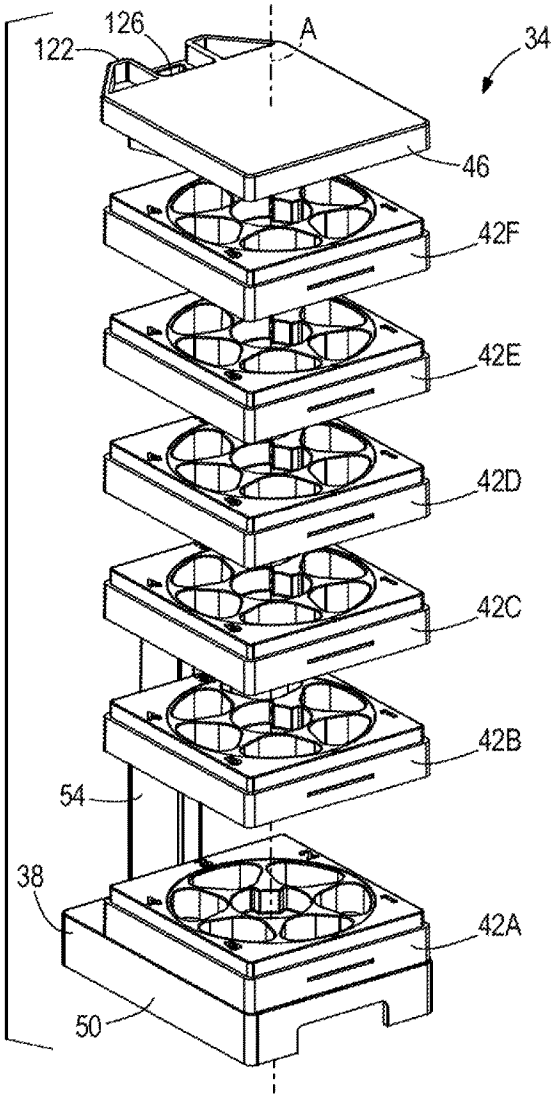
FIG. 3 is an exploded perspective view of the cassette.
Figure 2:
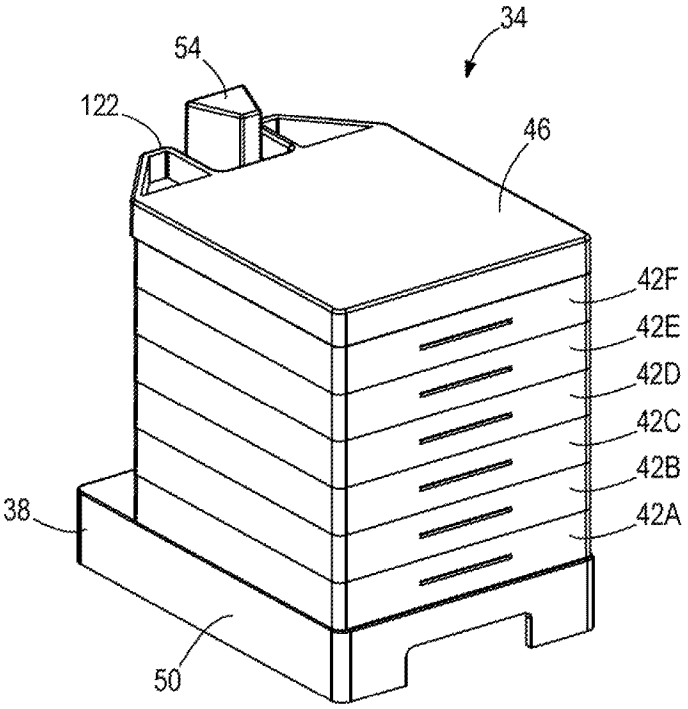
FIG. 2 is a perspective view of a cassette for use with the pharmacy packaging system.

FIGS. 2 and 3 illustrate another cassette 34 for use with the pharmacy packaging system 10. The illustrated cassette 34 includes a base 38, a plurality of plate assemblies 42, and a cover 46. In the illustrated embodiment, the cassette 34 includes six plate assemblies 42A-F stacked between the base 38 and the cover 46. In other embodiments, the cassette 34 may include fewer or more plate assemblies. The plate assemblies 42A-F are generally rectangular and arranged in a layered or stacked configuration such that the cassette 34 has a depth of about 4 inches, a width of about 2.5 inches, and a height of about 5 inches. In other embodiments, the cassette 34 may have other dimensions, outer shapes, and/or footprint areas suitable for use with other types of packaging systems.

Figure 5:
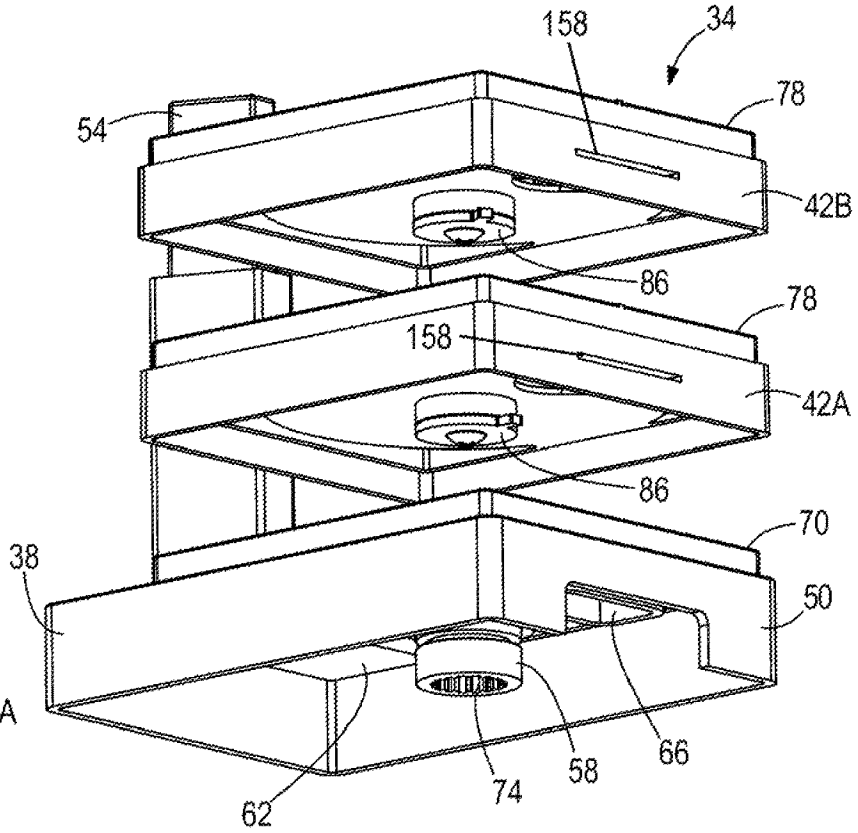
FIG. 5 is an exploded perspective view of another portion of the cassette.
Figure 4:
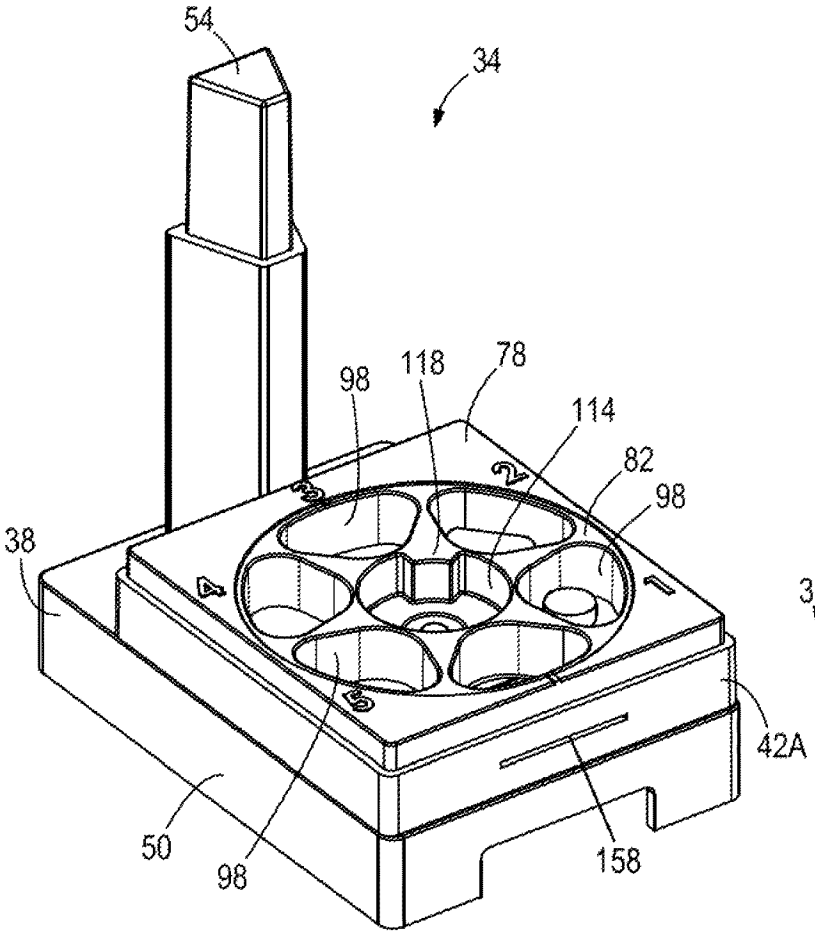
FIG. 4 is a perspective view of a portion of the cassette.

As shown in FIGS. 4 and 5, the illustrated base 38 includes a foot 50, a post 54 extending generally perpendicularly from the foot 50, and a drive member 58 coupled to a bottom surface 62 of the foot 50. The foot 50 is configured to receive and support the plate assemblies 42. The post 54 is fixed to a rear edge of the foot 50, and the plate assemblies 42 are stacked on top of the foot 50 in front of the post 54. In the illustrated embodiment, the foot 50 also includes a raised platform 70 that extends at least partially into the bottommost plate assembly 42A to inhibit the plate assemblies 42 from shifting laterally on the base 38. The foot 50 defines an outlet 66, or port, to dispense pharmaceuticals out of the cassette 34. The outlet 66 is formed through the bottom surface 62 of the foot 50.

The post 54 is configured to engage the cover 46 to inhibit the cover 46 from shifting or sliding relative to the base 38, but still allow the cover 46 to move vertically (i.e., toward and away from the foot 50) relative to the base 38. The cover 46 can also be removed entirely from the post 54 when inserting or removing the plate assemblies 42. In the illustrated cassette 34, the post 54 is not directly engaged with the plate assemblies 42. Instead, the post 54 is only engaged with the cover 46 and the foot 50. The cover 46 and foot 50 are then engaged with the top and the bottom plate assemblies 42, respectively, in order to hold the stack of assemblies 42 together. The post 54 also defines a gripping area, or handle, of the cassette 34 to facilitate grasping and carrying the cassette 34 with the gantry assembly 26 of the packaging system 10 or by hand.

The illustrated drive member 58 includes a splined inner surface 74 that is configured to engage a motor shaft extending from one of the motor bases 30 (FIG. 1). When the drive member 58 is engaged with the motor shaft, the motor base 30 can rotate the drive member 58 to operate (e.g., selectively open) the cassette 34. A portion of the drive member 58 also extends upwardly from the foot 50 and engages the bottommost plate assembly 42A to drive (e.g., rotate) and, thereby, open a portion of the plate assembly 42A.

Figure 7:
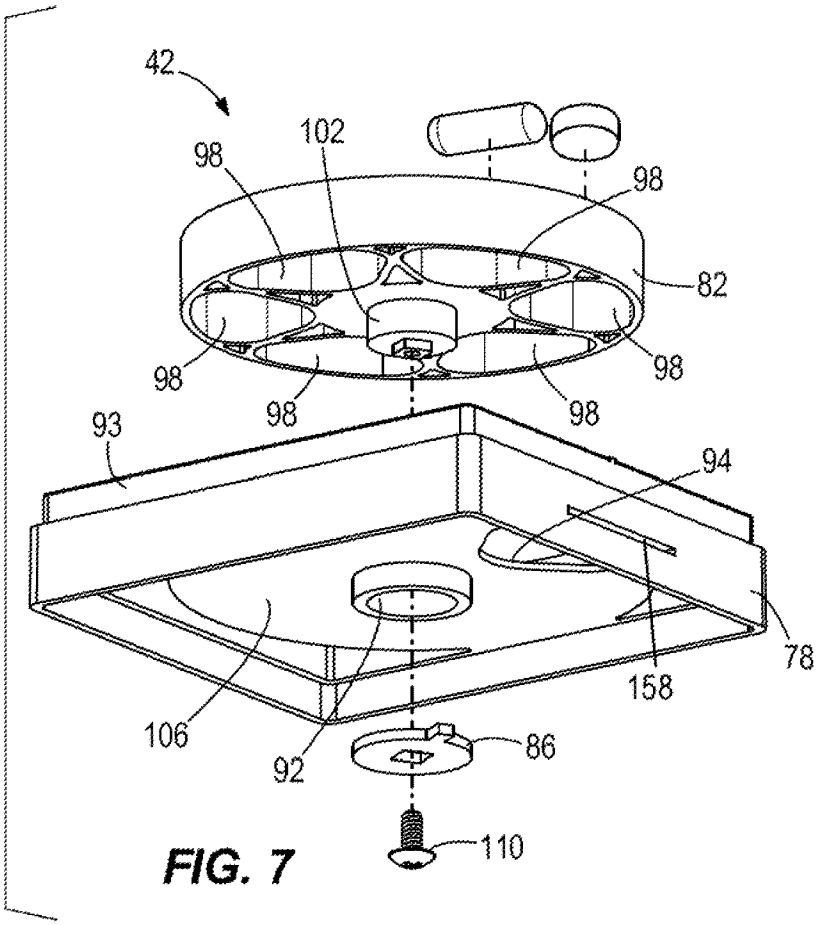
FIG. 7 is an exploded bottom perspective view of the plate assembly shown in FIG. 6.
Figure 6:
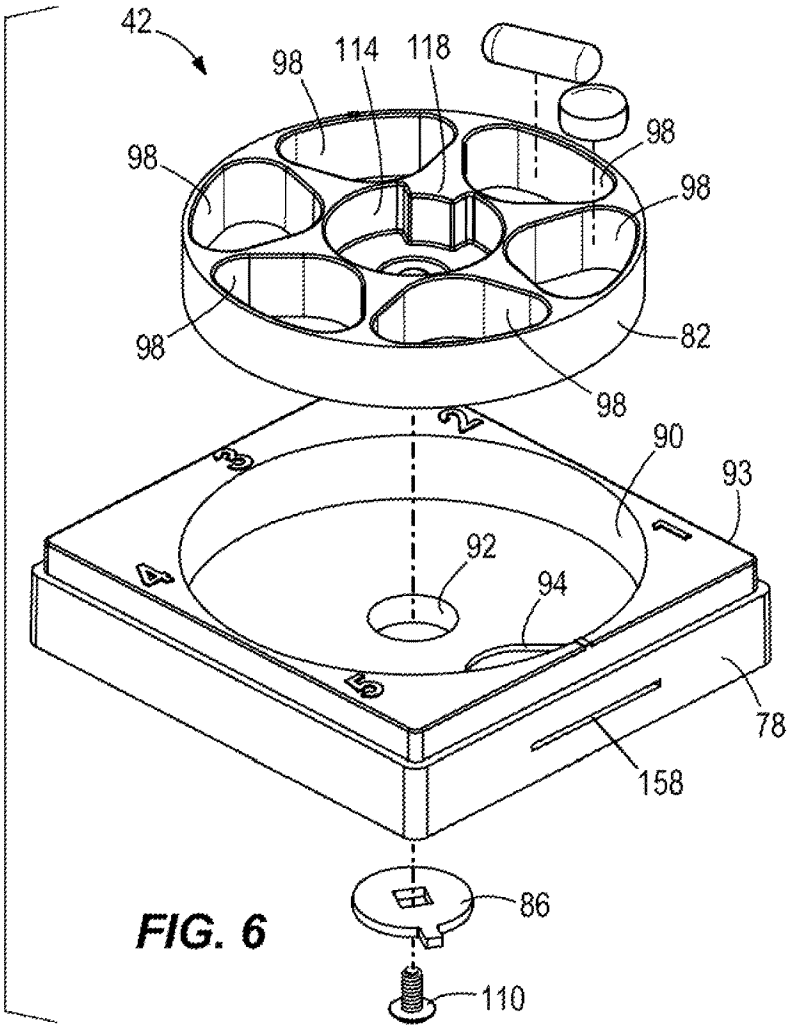
FIG. 6 is an exploded top perspective view of a plate assembly of the cassette.

As shown in FIGS. 6 and 7, each plate assembly 42 includes a plate body 78, a disk 82, and an indexing member 86. The illustrated plate body 78 is shaped to generally match the shape and size of the foot 50 so that outer peripheral surfaces of the plate assemblies 42 and the foot 50 are continuous. The illustrated plate body 78 is of a generally square shape with a circular recess 90. The plate body 78 also defines a hole 92 and an opening 94 within the circular recess 90. The circular recess 90 is shaped and sized to receive the disk 82. The opening 94 is aligned with the outlet 66 in the base 38. In the illustrated embodiment, the hole 92 and the opening 94 are located within the recess 90. In other embodiments, the hole 92 or the opening 94 may be located elsewhere on the plate body 78. Each plate body 78 also includes an outer surface having a recessed portion 93 (similar to the raised platform 70 of the foot 50). The recessed portion 93 of one plate body 78 is received in an adjacent plate body to inhibit shifting of the plurality of plate assemblies 42 relative to each other when in the stacked configuration.

The illustrated disk 82 is generally cylindrical and is received in the recess 90 of the plate body 78. The disk 82 defines a plurality of cubbies 98 configured to receive pharmaceuticals. In some embodiments, the disk 82 includes, for example, at least four cubbies 98. In the illustrated embodiment, the disk 82 includes six cubbies 98. In other embodiments, the disk 82 may include fewer or more cubbies 98. The cubbies 98 are defined by bottomless voids extending through the entire thickness of the disk 82. The disk 82 is rotatable relative to the plate body 78 (e.g., by rotating the disk 82 with one of the motor bases 30 (FIG. 1)) to selectively align each of the cubbies 98 with the opening 94 in the plate body 78. When a particular cubby 98 is aligned with the opening 94, the pharmaceutical drops out of the cubby 98, through the opening 94 in the plate body 78, through a cubby 98 and an opening 94 of a plate assembly 42 located beneath the plate assembly 42 (if present), and out of the cassette 34 through the outlet 66 in the base 38. When a particular cubby 98 is not aligned with the opening 94 in the plate body 78, the plate body 78 forms a bottom wall of the cubby 98 so that the pharmaceuticals are retained with the cubby 98 rather than dropping out. The disk 82 also includes a shaft 102 on the underside of the disk 82. The shaft 102 extends through the hole 92 of the plate body 78 and couples to the indexing member 86.

The indexing member 86, or indexing plate, is supported adjacent a lower surface 106 of the plate body 78 by the disk 82. In the illustrated embodiment, the indexing member 86 is coupled to the shaft 102 of the disk 82 by a threaded fastener 110 (e.g., a screw). In other embodiments, the indexing member 86 may be coupled to the shaft 102 using other suitable means. The indexing member 86 is configured to engage and be driven by the drive member 58 of the base 38 (FIG. 5) when the plate assembly 42 is the bottommost plate assembly 42A of the cassette 34. Alternatively, when the plate assembly 42 is not the bottommost plate assembly (i.e., when the plate assembly 42 is stacked on top of another plate assembly), the indexing member 86 is configured to engage and be driven by the plate assembly positioned directly beneath the current plate assembly 42.

As shown in FIG. 6, each disk 82 defines a central aperture 114 that provides clearance for an indexing member 86 of an adjacent plate assembly 42. The disk 82 also includes a projection 118 that extends into the central aperture 114. As the disk 82 rotates, the projection 118 engages the indexing member 86 of the adjacent plate assembly 42 to rotate the disk 82 of the adjacent plate assembly 42. The plate assemblies 42 are, thereby, coupled together in a clock-like fashion so that each disk 82 begins rotating an adjacent disk after completing a full revolution. In other embodiments, other suitable mechanisms may be employed to transmit force (e.g., rotation) between adjacent plate assemblies 42.

As shown in FIGS. 2 and 3, the cover 46 is coupled to the post 54 of the base 38 and stacked on top of the uppermost plate assembly 42F. The cover 46 extends over the uppermost plate assembly 42F to enclose the cassette 34. In the illustrated embodiment, the cover 46 includes a tang 122 defining a slot 126 that receives the post 54. The tang 122 inhibits the cover 46 from shifting or rotating relative to the base 38, but allows the cover 46 to slide vertically along the post 54. In some embodiments, the cover 46 may include a lock mechanism that engages the base 38 or one of the plate assemblies 42 to inhibit unauthorized tampering or removal of pharmaceuticals from the cassette 34.

Referring to FIG. 3, in operation, when the cassette 34 is positioned on and connected to a motor base, the drive member 58 (FIG. 5) is selectively driven by the motor base 30 (FIG. 1). As the drive member 58 is rotated, the drive member 58 engages and rotates the indexing member 86 of the bottommost plate 42A assembly to rotate the disk 82. The disk 82 rotates within the recess 90 of the plate body 78 about a vertical axis A. In the illustrated embodiment, the vertical axis A is generally parallel to the post 54. Rotating the disk 82 sequentially moves each of the cubbies 98 in the disk 82 into alignment with the opening 94 in the plate body 78. When a particular cubby 98 is aligned with the opening 94, a pharmaceutical located inside that cubby 98 drops through the opening 94 and out of the cassette 34 through the outlet 66 in the base 38.

After the disk 82 of the bottommost plate assembly 42A has completed a full revolution (or nearly a full revolution), the projection 118 of the disk 82 engages the indexing member 86 of an adjacent plate assembly (i.e., the plate assembly 42B stacked on top of the bottommost plate assembly 42A) to begin rotating the disk 82 of the adjacent plate assembly 42B. Similar to the bottommost plate assembly 42A, the disk 82 of the adjacent plate assembly 42B rotates about the vertical axis A to sequentially move each of the cubbies 98 in the disk 82 into alignment with the opening 94 in the plate body 78. When a particular cubby 98 is aligned with the opening 94, a pharmaceutical located inside that cubby 98 drops through the opening 94, drops through the aligned cubby 98 and opening 94 of the bottommost plate assembly 42A, and out of the cassette 34 through the outlet 66 in the base 38. This process can continue for each of the plate assemblies 42C-F stacked in the cassette 34 until the cassette 34 is empty (i.e., until the uppermost plate assembly 42F drops all of its pharmaceuticals).

Figure 8:
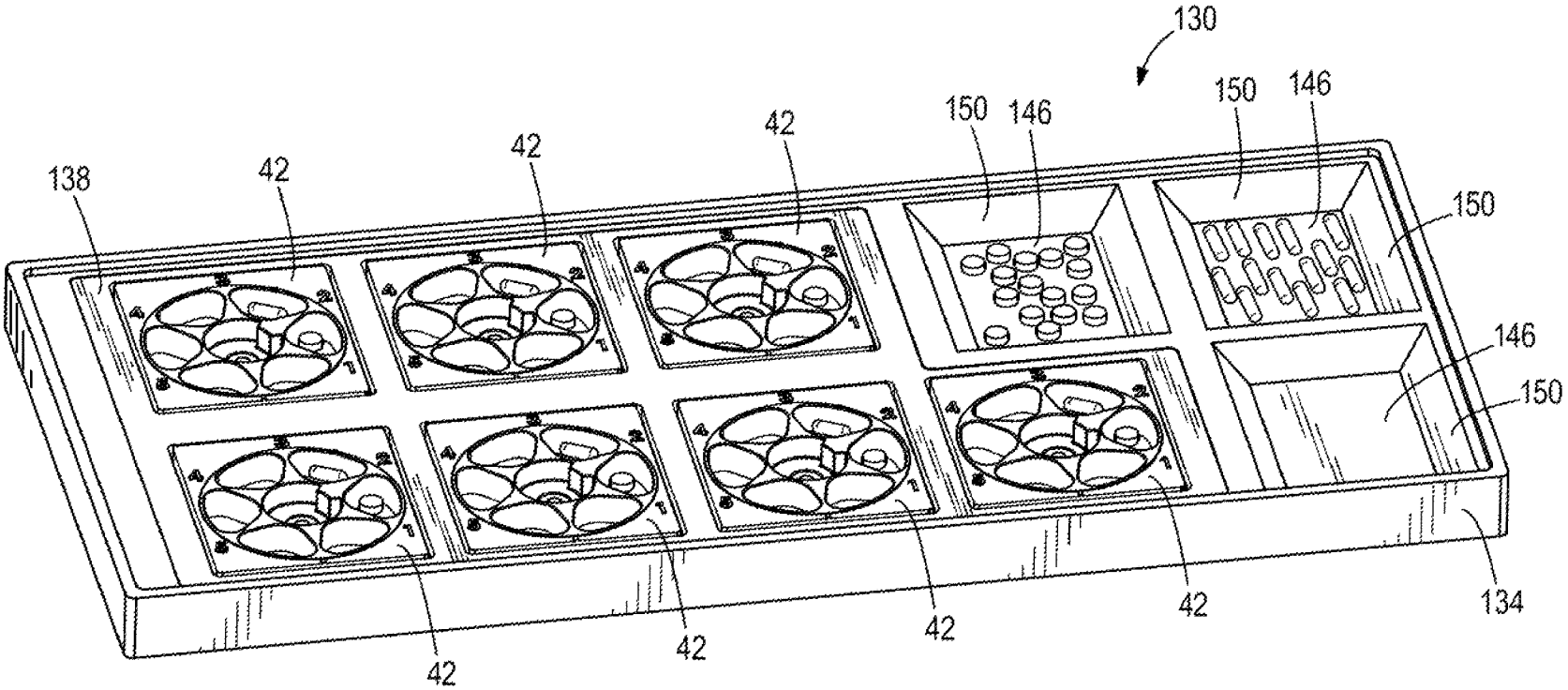
FIG. 8 is a perspective view of a loading station for use with the cassette.
Figure 9:
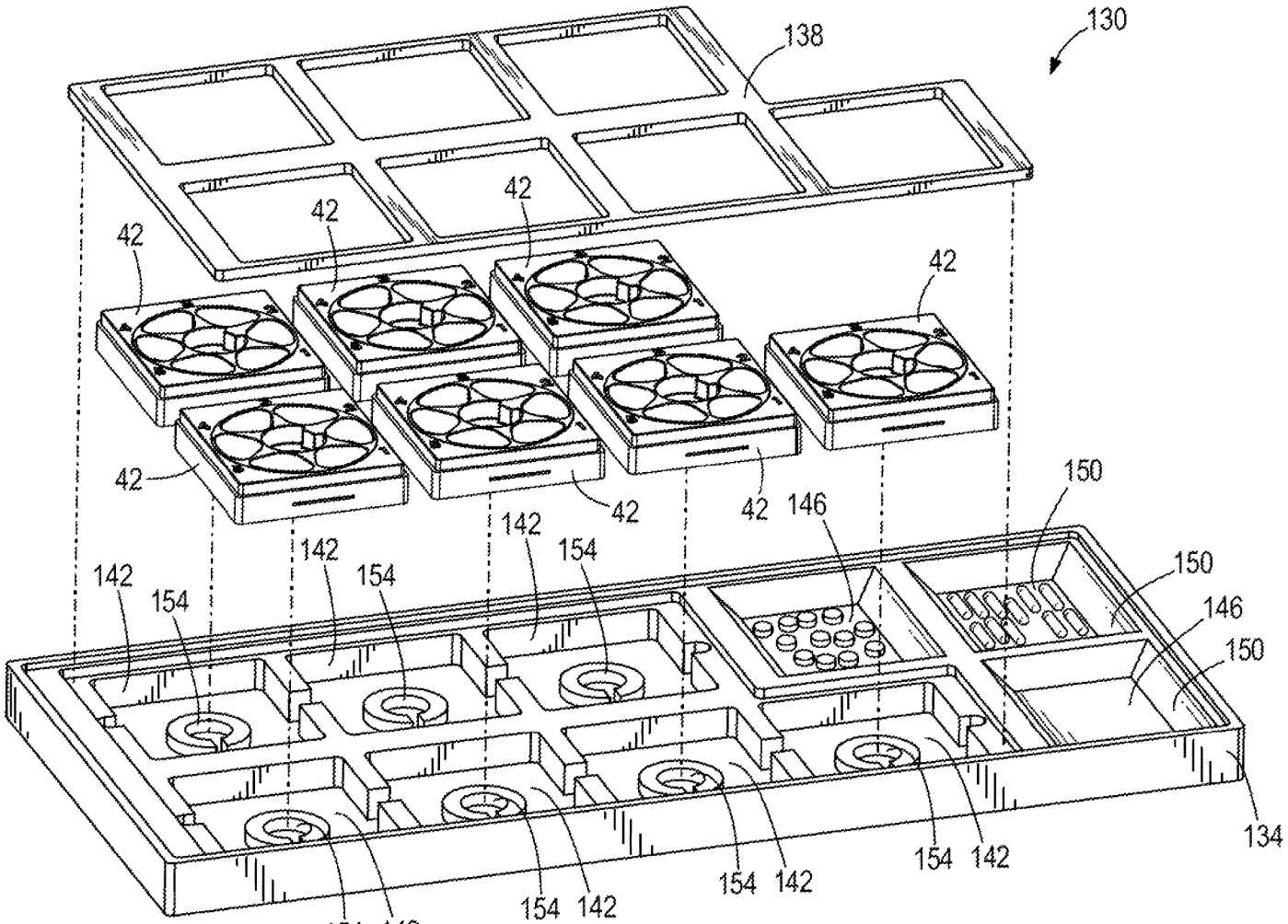
FIG. 9 is an exploded perspective view of the loading station shown in FIG. 8.

FIGS. 8 and 9 illustrate a loading station 130 for loading and refilling the cassettes 34. The illustrated loading station 130 includes a base container 134 and a cover 138. The container 134, or platform, defines cutouts 142 to receive the plate assemblies 42 of one or more cassettes 34. In the illustrated embodiment, the container 134 defines seven cutouts 142 such that the loading station 130 can simultaneously receive and support seven plate assemblies 42. In other embodiments, the container 134 may define fewer or more cutouts. The illustrated container 134 also defines a plurality of recesses 146 to temporarily receive and store supplies of pharmaceuticals. The recesses 146 help separate the pharmaceuticals so that a user can quickly and easily load the pharmaceuticals into the plate assemblies 42. In the illustrated embodiment, the recesses 146 are defined by sloped sides 150 of the base container 134 to facilitate removal of the pharmaceuticals from the recesses 146.

As shown in FIG. 9, each cutout 142 includes an upwardly-extending boss 154. The boss 154 is configured to receive the indexing member 86 of each plate assembly 42 in a predetermined orientation to ensure the plate assembly 42 is seated correctly on the base container 134. For example, the disk 82 in the plate assembly 42 is rotated to a load position, in which one of the cubbies 98 (a "zero" cubby) is aligned with the opening 94 in the plate body 78. A user then recognizes not to load a pharmaceutical into this cubby 98 because the pharmaceutical will drop straight through the plate assembly 42. Such an arrangement also helps ensure that the plate assembly 42 is reset for proper stacking on the base 38. That is, all of the "zero" cubbies 98 are in the same position/orientation so that when a user stacks the plate assemblies 42, the "zero" cubbies 98 are aligned at the same starting position.

In some embodiments, each cutout 142 may also include a secondary projection, or the secondary projection may be part of each boss 154. The secondary projection extends upwardly from the base container 134 into one of the cubbies 98 (i.e., the "zero" cubby) in the corresponding plate body 78. The secondary projection inhibits pills from being loaded into this particular cubby 98.

The cover 138 is releasably coupled to the base container 134 when the plate assemblies 42 are positioned in the cutouts 142. The cover 138 is configured to extend partially over each of the plate assemblies 42 to create a smooth surface. Such an arrangement helps hold the plate assemblies 42 in place. In addition, such an arrangement facilitates sliding pharmaceuticals into each plate assembly 42 without the pharmaceuticals becoming snagged or stuck between the plate assemblies 42.

In some embodiments, the cover 138 may include extended blocking portions. Each blocking portion is associated with one of the cutouts 142 and corresponding plate bodies 78. The blocking portion extends over one of the cubbies 98 (i.e., the "zero" cubby) in the plate body 78 to inhibit pills from being loaded into this particular cubby 98.

In other embodiments, the cassette 34 could be refilled in a more automated fashion without completely disassembling the cassette 34. In such embodiments, the cover 46 can be removed from the base 38 and the stacked plate assemblies 42. A thin member can be inserted into each plate assembly 42 beneath the opening 94 in the plate body 78. In particular, the thin member could be inserted through a slot 158 (FIGS. 4-5) formed in a front face of each plate body 78. The thin member would inhibit pharmaceuticals from dropping through the cubby 98 that is aligned with the opening 94. The plate assemblies 42 can be sequentially reloaded (i.e., from the lowermost plate assembly 42A to the uppermost plate assembly 42F) by rotating the disks 82 with the drive member 58. For example, the lowermost plate assembly 42A could be filled by first inserting the thin member into the slot 158 of the plate assembly 42A, and dropping pharmaceuticals through the other plate assemblies 42B-42F until the lowermost plate assembly 42A is filled. The pharmaceuticals could be dropped by a machine or manually into the cassette 34 as a motor rotates the drive member 58 and the disks 82. When the lowermost plate assembly 42A is full, the thin member can be removed from the lowermost plate assembly 42A and inserted into the slot 158 of the next plate assembly 42B. The next plate 42B can likewise be filled, and the process can be repeated until all of the plate assemblies 42 are filled. Once the plate assemblies 42 are filled, the cover 46 can be replaced.

The illustrated cassette 34 provides a storage container for storing and dispensing pharmaceuticals in a consistent manner. The cassette 34 allows different types of pharmaceuticals to be dispensed uniformly (e.g., one at a time) without requiring fine-tuning of an existing, open-type container. As such, the cassette 34 can be easily implemented into a pharmaceutical packaging system to dispense little-used or new types of pills for which a suitable open-bodied container does not exist. The cassette 34 can also be used to dispense partial (e.g., half) pills with jagged and/or uneven edges. In addition, the cassette 34 can be used to more consistently dispense gel caps because the gel caps are stored in discrete cubbies and, therefore, will not stick together.

Although the illustrated plate assemblies 42 each include six cubbies 98 that can simultaneously store five pharmaceuticals, the plate assemblies 42 may alternatively include different shapes and/or sizes of cubbies. For example, each plate assembly 42 may include ten or more cubbies to increase the pill density within the cassette. Alternatively, each plate assembly 42 may include fewer, but larger cubbies to receive and dispense larger pharmaceuticals.

Various features and advantages of the invention are set forth in the following claims.

What is claimed is:

1. A cassette for dispensing pharmaceuticals, the cassette comprising:

a base defining an outlet and including a drive member, the drive member configured to be rotated; and a plurality of plate assemblies supported by the base in a stacked configuration, each plate assembly including a plate body defining an opening aligned with the outlet, and a disk defining a plurality of cubbies, each disk being rotatable relative to a corresponding plate body by rotating the drive member of the base to selectively align each cubby with the opening in the corresponding plate body, wherein the plurality of plate assemblies includes a first plate assembly and a second plate assembly adjacent the first plate assembly, wherein the disk of the first plate assembly is coupled to the drive member, wherein the first plate assembly is a bottommost plate assembly of the plurality of plate assemblies and the second plate assembly is stacked on top of the first plate assembly, wherein the disk of the first plate assembly selectively engages the disk of the second plate assembly, wherein the disk of the first plate assembly is driven by the drive member to move one of the plurality of cubbies into alignment with the outlet while the disk of the first plate assembly is disengaged from the disk of the second plate assembly, and wherein the disk of the first plate assembly is driven by the drive member to move another of the plurality of cubbies into alignment with the outlet while the disk of the first plate assembly engages the disk of the second plate assembly so the first plate assembly is emptied before the second plate assembly.

2. The cassette of claim 1, wherein each plate assembly also includes an indexing member, and wherein the indexing member is configured to be driven by the drive member to rotate the disk.

3. The cassette of claim 2, wherein the disk of each plate assembly includes a shaft that extends through a hole in the corresponding plate body, and wherein the shaft is coupled to the indexing member on an opposite side of the plate body from the disk.

4. The cassette of claim 2, wherein the first plate assembly defines a central aperture through the disk of the first plate assembly and includes a projection that extends into the central aperture, wherein the central aperture is configured to receive the indexing member of the second plate assembly, and wherein the projection selectively engages the indexing member of the second plate assembly as the first plate assembly rotates.

5. The cassette of claim 1, wherein the plate body of each plate assembly defines a recess that receives the disk.

6. The cassette of claim 5, wherein the opening of the plate body is located within the recess.

7. The cassette of claim 1, wherein the base includes a foot configured to be supported on a motor base of a pharmacy packaging system, and wherein the drive member extends from a lower surface of the foot and is configured to be rotated by the motor base.

8. The cassette of claim 1, further comprising a cover coupled to the base, wherein the cover extends over an uppermost plate assembly of the plurality of plate assemblies.

9. The cassette of claim 8, wherein the base includes a foot and a post extending generally perpendicularly from the foot, wherein the post engages the cover, and wherein the foot supports the plurality of plate assemblies.

10. The cassette of claim 1, wherein the plate body of each plate assembly forms a bottom wall of each cubby in the disk when each cubby is not aligned with the opening.

11. The cassette of claim 1, wherein the disk of each plate assembly includes at least four cubbies.

12. The cassette of claim 1, wherein the plate body of each plate assembly includes an outer surface having a recessed portion that is received in the plate body of another plate assembly to inhibit shifting of the plurality of plate assemblies relative to each other when in the stacked configuration.

13. A method of dispensing pharmaceuticals from a cassette, the cassette including a base and a plurality of plate assemblies supported by the base in a stacked configuration, the plurality of plate assemblies including a first plate assembly and a second plate assembly adjacent the first plate assembly, the first plate assembly being a bottommost plate assembly of the plurality of plate assemblies and the second plate assembly being stacked on top of the first plate assembly, the base defining an outlet and including a drive member, each plate assembly including a plate body defining an opening aligned with the outlet and a disk and defining a plurality of cubbies, the method comprising:

coupling the drive member to a motor base, wherein the drive member is also coupled to the disk of the first plate assembly;

rotating the disk of the first plate assembly to move one of the plurality of cubbies into alignment with the outlet while the disk of the first plate assembly is disengaged from the disk of the second plate assembly;

rotating the disk of the first plate assembly to move another of the plurality of cubbies into alignment with the outlet while the disk of the first plate assembly engages the disk of the second plate assembly; and rotating the disk of a second plate assembly relative to the corresponding plate body with the motor base to selectively align each cubby of the disk of the second plate assembly with the opening in the corresponding plate body, wherein rotating the disk of the second plate assembly includes engaging the disk of the second plate assembly with a portion of the disk of the first plate assembly to rotate the disk of the second plate assembly so the first plate assembly is emptied before the second plate assembly is emptied.

14. The method of claim 13, further comprising dropping a pharmaceutical out of each cubby of the first plate assembly through the opening of the first plate assembly and the outlet of the base as each cubby is selectively aligned with the opening.

15. The method of claim 14, further comprising dropping a pharmaceutical out of each cubby of the second plate assembly through the opening of the second plate assembly, the opening of the first plate assembly, and the outlet of the base as each cubby is selectively aligned with the opening.

16. The method of claim 13, wherein each plate assembly also includes an indexing member, and wherein rotating the disk of the first plate assembly includes rotating the disk of the first plate assembly by driving the indexing member of the first plate assembly with the drive member.

17. The method of claim 16, wherein the first plate assembly defines a central aperture and includes a projection that extends into the central aperture, wherein the indexing member of the second plate assembly is received within the central aperture of the first plate assembly, and wherein rotating the disk of the second plate assembly includes engaging the indexing member of the second plate assembly with the projection of the first plate assembly.

18. The method of claim 13, wherein the plate body of each plate assembly defines a recess that receives the disk, wherein rotating the disk of the first plate assembly includes rotating the disk of the first plate assembly within the recess, and wherein rotating the disk of the second plate assembly includes rotating the disk of the second plate assembly within the recess.

19. The method of claim 13, wherein rotating the disk of the first plate assembly includes rotating the disk of the first plate assembly about a vertical axis, and wherein rotating the disk of the second plate assembly includes rotating the disk of the second plate assembly about the vertical axis.

* * * * *